US009672696B2

(12) United States Patent
Adams

(10) Patent No.: US 9,672,696 B2
(45) Date of Patent: Jun. 6, 2017

(54) GAMING SYSTEM AND METHOD INCORPORATING WINNING ENHANCEMENTS

(71) Applicant: IGT CANADA SOLUTIONS ULC, Moncton (CA)

(72) Inventor: Khaled Adams, Moncton (CA)

(73) Assignee: IGT CANADA SOLUTIONS ULC, Moncton (CA)

( * ) Notice: Subject to any disclaimer, the term of this patent is extended or adjusted under 35 U.S.C. 154(b) by 248 days.

(21) Appl. No.: 13/631,129

(22) Filed: Sep. 28, 2012

(65) Prior Publication Data

US 2014/0094268 A1 Apr. 3, 2014

(51) Int. Cl.
*A63F 9/24* (2006.01)
*G07F 17/32* (2006.01)
*G07F 17/34* (2006.01)

(52) U.S. Cl.
CPC ..... *G07F 17/3267* (2013.01); *G07F 17/3288* (2013.01); *G07F 17/34* (2013.01);
(Continued)

(58) Field of Classification Search
CPC .... G07F 17/32; G07F 17/3244; G07F 17/326; G07F 17/3267; G07F 17/34; G07F 17/3213
(Continued)

(56) References Cited

U.S. PATENT DOCUMENTS 7,014,559 B1 3/2006 Fong
2003/0190948 A1 10/2003 Baerlocher et al.
(Continued)

FOREIGN PATENT DOCUMENTS

CA 2800295 3/2014
CA 2827465 3/2014

OTHER PUBLICATIONS

Canadian Intellectual Property Office, Office Action dated Dec. 15, 2014, issued on corresponding Canadian Patent Application No. 2,800,295.

*Primary Examiner* — William H McCullogh, Jr.
*Assistant Examiner* — Chase Leichliter
(74) *Attorney, Agent, or Firm* — Sage Patent Group

(57) ABSTRACT

A computer implemented method is provided for integrating winning enhancements with a video game performed by a video gaming computer device comprising: selecting on a random basis a first set of chance elements, that determine a first gaming outcome; retrieving one or more rules for generating and displaying video gaming output based on the first set of chance elements, the video gaming output including a first set of gaming elements organized in a first array; displaying the first set of gaming elements; selecting on a random basis a second set of chance elements that determine a second gaming outcome; retrieving one or more rules for generating and displaying video gaming output based on the second set of chance elements as a second set of gaming elements that produce winning enhancements, the second set of gaming elements being organized in a second array; and displaying the winning enhancements in way that simulates the second set of gaming elements interacting physically with the first set of gaming elements. In another aspect, the second set of gaming elements interact with the first set of gaming elements via a grid overlay. A gaming device, gaming computer system, and gaming computer program that incorporates the wining enhancements is also provided.

19 Claims, 10 Drawing Sheets

(52) U.S. Cl.
CPC ..... *G07F 17/32* (2013.01); *G07F 17/326* (2013.01); *G07F 17/3213* (2013.01)

(58) Field of Classification Search
USPC ..... 463/1, 16–21, 25, 42, 43
See application file for complete search history.

(56) References Cited

U.S. PATENT DOCUMENTS

| | | | | |
|---|---|---|---|---|
| 2004/0063491 | A1* | 4/2004 | Banyai | G07F 17/32 463/22 |
| 2006/0287060 | A1* | 12/2006 | Yoshimi | 463/20 |
| 2008/0090636 | A1* | 4/2008 | Lathrop | 463/20 |
| 2012/0077564 | A1* | 3/2012 | Collette et al. | 463/20 |
| 2012/0077566 | A1* | 3/2012 | Schultz et al. | 463/20 |
| 2012/0122547 | A1* | 5/2012 | Aoki et al. | 463/20 |
| 2013/0178271 | A1* | 7/2013 | Aponte et al. | 463/20 |
| 2014/0094249 | A1* | 4/2014 | Gugler et al. | 463/20 |

* cited by examiner

GAMING SYSTEM AND METHOD INCORPORATING WINNING ENHANCEMENTS

FIELD OF THE INVENTION

This invention relates to electronic gaming systems, such as on-line gaming and gaming systems in casinos.

BACKGROUND

Various video gaming systems or machines are known. These may consist of slot machines, online gaming systems (that enable users to play games using computer devices, whether desktop computers, laptops, tablet computers or smart phones), computer programs for use on a computer device (including desktop computer, laptops, tablet computers of smart phones), or gaming consoles that are connectable to a display such as a television or computer screen.

Video gaming machines may be configured to enable users to play a variety of different types of games. One types of game displays a plurality of moving arrangements of gaming elements (such as reels, and symbols on reels), and one or more winning combinations are displayed using a pattern of gaming elements in an arrangement of cells (or an "array"), where each cell may include a gaming element, and where gaming elements may define winning combinations (or a "winning pattern").

Games that are based on winning patterns may be referred to as "pattern games" in this disclosure.

One example of a pattern game is a game that includes spinning reels, where a user wagers on one or more lines, activates the game, and the spinning reels are stopped to show one or more patterns in an array. The game rules may define one or more winning patterns of gaming elements, and these winning patterns may be associated with credits, points of the equivalent.

U.S. Pat. No. 6,439,996 issued to O'Halloran describes a method and apparatus for operating gaming machines where a plurality of simulated reels including a plurality of symbols are provided, and a first wild card symbol replaces at least one of the symbols, and if a winning combination of symbols results, at least a second wild card symbol is provided.

A skilled reader will understand tat other winning enhancements are known.

Gaming systems or machines of this type are poplar, however, there is a need to compete for the attention of users, and therefore it is necessary to innovate by launching new, engaging game features.

SUMMARY

In one aspect of the invention, a computer implemented method is provided for integrating winning enhancements with a video game performed by a video gaming computer device comprising:

selecting on a random basis a first set of chance elements, that determine a first gaming outcome;

retrieving one or more rules for generating and displaying video gaming output based on the first set of chance elements, the video gaming output including a first set of gaming elements organized in a first array;

displaying the first set of gaming elements;

selecting on a random basis a second set of change elements that determine a second gaming outcome;

retrieving one or more rules for generating and displaying video gaming output based on the second set of chance elements as a second set of gaming elements that produce winning enhancements, the second set of gaming elements being organized in a second array; and displaying the winning enhancements in way that simulates the second set of gaming elements interacting physically with the first set of gaming elements.

In another aspect, the second array consists of a grid overlay relative to the first array.

In another aspect, the second set of gaming elements interact with the first set of gaming elements via the grid overlay.

In a still other aspect, the method comprises simulating that the second set of gaming elements modifies the first gaming outcomes depending on the physical interactions between the first set of gaming elements and the second set of gaming elements so as to produce optionally a second gaming outcome based on the winning enhancements.

In another aspect, the second array of gaming elements is an overlay to the first array of gaming elements.

In yet another aspect, the first array includes a plurality of cells for receiving the gaming elements, and the second array includes a plurality of cells that fit within the cells of the first array.

In another aspect, the first set of gaming elements simulate reels, and the second set of gaming elements simulate physical objects capable of interacting physically with the reels, including balls or dice.

In another aspect, using a display controller: (A) the second set of gaming elements are depicted as appearing on the display, and moving on the display in a way that interacts with the first set of gaming elements; and (B) the second set of gaming elements are depicted as achieving a resting position relative to the first set of gaming elements wherein the second set of gaming elements are situated on one or more cells of the second array in a way that overlaps with the underlying first array.

In a still other aspect, the method further comprises the steps of: (A) accessing one or more gaming rules that determine the gaming outcomes, if any, associated with the placement of second set of gaming elements relative to the first set of gaming elements in the resting position; and (B) applying the gaming rules to calculate winnings if any, and display messaging based on application of the gaming rules.

In another aspect, the method comprises using the second set of gaming elements to produce a simulation of one or more physical objects represented by the second set of gaming elements falling on one or more physical objects representing the first set of gaming elements; wherein the simulation is based on how the physical objects representing the second set of gaming elements would interact physically with the physical objects representing the first set of gaming elements.

In another aspect, a gaming device is provided comprising: a display screen: and a processing system running a game computer program to carry out the following method:

selecting on a random basis a first set of chance elements, that determine a first gaming outcome;

retrieving one or more rules for generating and displaying video gaming output based on the first set of chance elements, the video gaming output including a first set of gaming elements organized in a first array;

displaying the first set of gaming elements;

selecting on a random basis a second set of chance elements that determine a second gaming outcome;

retrieving one or more rules for generating and displaying video gaming output based on the second set of chance elements as a second set of gaming elements that produce winning enhancements, the second set of gaming elements being organized in a second array; and displaying the winning enhancements in way that simulates the second set of gaming elements interacting physically with the first set of gaming elements.

In another aspect, a gaming computer system for incorporating winning enhancements into a video game is provided comprising:

one or more server computers, the server computer being linked to a server computer program, wherein the server computers and the server computer program define one or more computer implemented utilities or services made accessible to users using one or more computer devices linked to a computer network, the computer devices including a display screen;

wherein the computer implemented utilities or services include:

(A) a display controller that is operable to access a plurality of gaming rules, including (i) rules of play (including pay-out rules) and game display rules, and based on the gaming rules to generate gaming output for display to the users; the display controller including or being linked to a physical attribute simulator; and (B) a random generator linked to the display controller and operable to generate random selections, as part of the gaming rules, thereby producing gaming outcomes;

wherein based on random selection(s) of the random generator, the gaming controller generates and displays a first level winning pattern consisting of a first set of gaming elements, and a second level winning pattern consisting of a second set of gaming elements, wherein the second level winning pattern is an overlay to the first level winning pattern; and wherein the physical attribute simulator enables the display controller to represent or simulate the second set of gaming elements interacting physically with first set of gaming elements through the overlay so as to produce one or more gaming outcomes.

In another aspect, the display controller displays the first set of gaming elements and the second set of gaming elements as moving physical objects, and the interactions between the first set of gaming elements and the second set of gaming elements simulate the way the moving physical objects would interact in the physical world.

In another aspect of the gaming computer system, the first set of gaming elements consist of symbols displayed on moving reels, and the second set of gaming elements represent balls or dice, and the display controller simulates the balls or dice being dropped over the moving reels, and the balls or dice colliding with the surface of the moving reels, and optionally with one another, until the balls or dice achieve a resting position.

In another aspect of the gaming computer system, resting position the balls or dice each achieve a position relative to one or more underlying symbols, and based on this position or collective position, a gaming outcome is displayed.

In yet another aspect, a modulated data signal is provided having computer-executable instructions embodied thereon comprising: (A) a display control module that is operable to access a plurality of gaming rules, including (i) rules of play (including pay-out rules) and game display rules, and based on the gaming rules generate gaming output for display to the users; the display controller including or being linked to a physical attribute simulator; and (B) a random generator module linked to the display controller and operable to generate random selections, as part of the gaming rules, thereby producing gaming outcomes;

wherein based on random selection(s) of the random generator module, the gaming control module generates and displays a first level winning pattern consisting of a first set of gaming elements, and a second level winning pattern consisting of a second set of gaming elements, wherein the second level winning pattern is an overlay to the first level winning pattern; and wherein the physical attribute simulator enables the display control module to represent or simulate the second set of gaming elements interacting physically with first set of gaming elements through the overlay.

In a still other aspect, a computer program is provided for instructing one or more computers to perform a method for integrating winning enhancements with a video game performed by a video gaming computer device comprising:

selecting on a random basis a first set of chance elements, that determine a first gaming outcome;

retrieving one or more rules for generating and displaying video gaming output based on the first set of chance elements, the video gaming output including a first set of gaming elements organized in a first array;

displaying the first set of gaming elements;

selecting on a random basis a second set of chance elements, that determine a second gaming outcome;

retrieving one or more rules for generating and displaying video gaming output based on the second set of chance elements as a second set of gaming elements that produce winning enhancements, the second set of gaming elements being organized in a second array; and displaying the winning enhancements in way that simulates the second set of gaming elements interacting physically with the first set of gaming elements.

Various other embodiments are described.

BRIEF DESCRIPTION OF THE DRAWINGS

Elements that are the same or equivalent are labeled with the same numeral.

DETAILED DESCRIPTION

Figure 1:
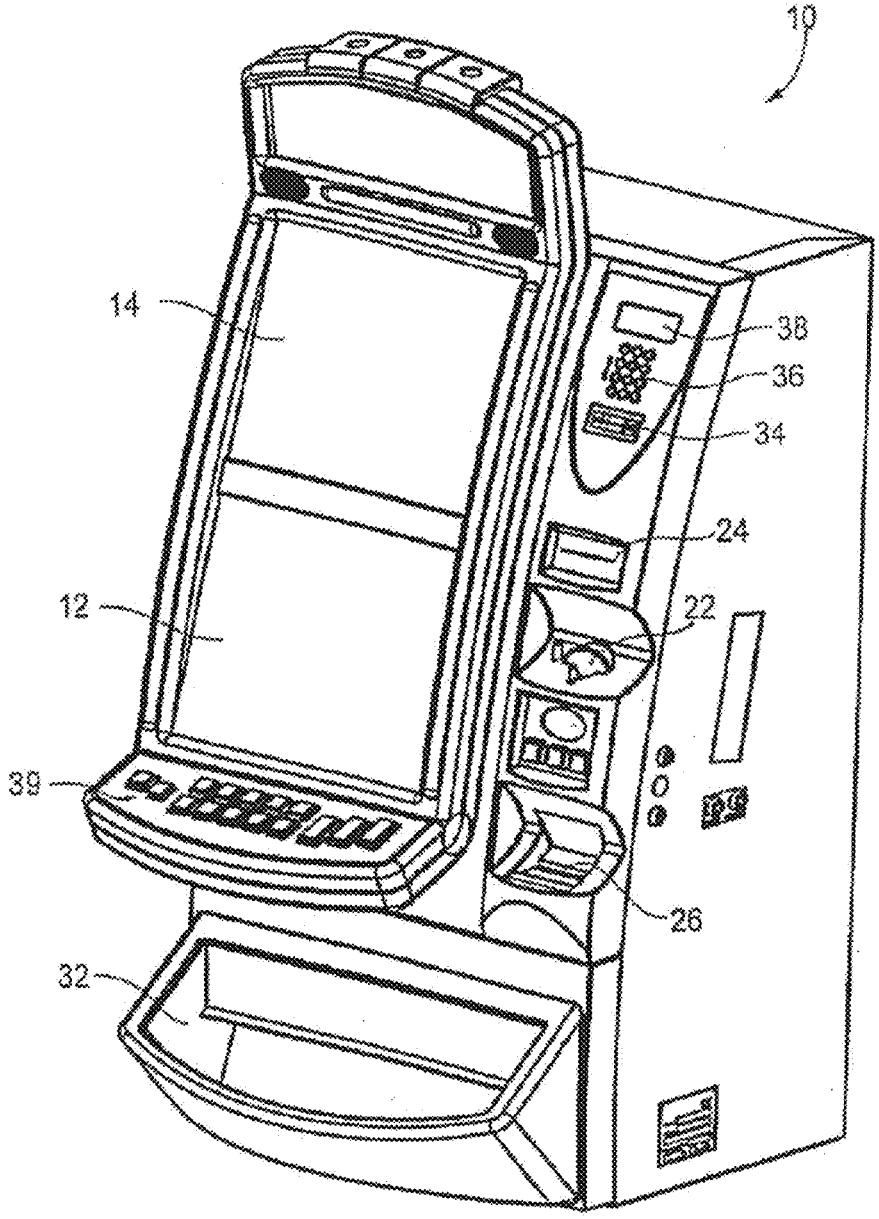
FIG. 1 is a perspective view of one type of gaming machine that may be programmed to carry out invention.

The invention may be implemented using any type of computer, including desktop computers, laptop computers, tablet computers and other portable devices, such as smart phones (collectively a "computer device"), that can access a gaming site or a portal (which may access a plurality of gaming sites) via the internet or other communication path (e.g., a LAN or WAN).

The invention may also be implemented on any type of gaming console (and associated user input devices) that may connect to a display to enable users to play games using the gaming console and the display.

The invention may also be implemented as a computer program, configured to provide the functionality described in this disclosure on any type of computer device.

The invention may also be implemented using a cloud computing network, and may be provided based on a software as a service (SAAS) computer network configuration, where the features and functions disclosed herein may be made available as an Internet service, using various mechanisms known to those skilled in the art.

Further details regarding possible implementations of the invention are provided below.

Winning Enhancements

A video gaming computer system and computer implemented video gaming method is provided that incorporates winning enhancements, as described herein, into pattern games.

A random selector selects on a random basis a first random selection (which may be a set of chance elements or symbols for example). The first random selection may determine the gaming outcome, or may be used to generate the gaming outcome. The winning pattern including the gaming elements constitute a representation of the first random selection, and may be referred to as a "first level winning pattern." The array that displays the gaming elements of the first level winning pattern may be referred to as the "first array."

A pay-out component may store pay-out attributes associated with each random selection. A skilled reader will appreciate that various pay-out attributes, and mechanisms for presenting these to a user, may be used in the video gaming computer system and computer implemented video gaming methods of the present invention.

The present gaming system and method enables video games of various types that include winning enhancements as described herein that are thereby more engaging and stimulating.

The innovation of the present invention is a mechanism for incorporating winning enhancements into pattern games in a new and innovative manner that is engaging and stimulating for players.

The random generator may be configured to generate a second random selection. The gaming computer system and the computer implemented gaming method are configured so as to integrate the second random selection into the first random selection so as to potentially modify the first random selection. Modifications to the first random selection may result in a change in the gaming outcome.

In another aspect, the second random selection initiates the gaming computer system to display gaming elements corresponding to the second random selection that are also organized in an arrangement of cells to form a second array, thereby defining a "second level winning pattern".

In another aspect of the invention, the second level winning pattern is associated with the first level winning pattern, such that the second level winning pattern is displayed in a way that simulates the second level winning pattern impacting on the outcome(s) associated with the first level winning pattern.

In another aspect of the invention, the gaming computer system is configured to display the gaming elements of the second level winning pattern as an overlay to the first level winning pattern.

In another aspect of the invention, one or more cells for the first array include one or more cells of the second array, thereby displaying an integrated winning pattern based on interrelationships or interactions between first array gaming elements (or "first set of gaming elements") and second array gaming elements (or "second set of gaming elements").

In another aspect of the invention the interaction between the first set of gaming elements and second set of gaming elements displayed by the video gaming computer system simulates physical interactions between the first set of gaming elements and the second set of gaming elements.

In one aspect of the present invention:

(A) the gaming computer system defines an overlay that is applied to the first array to provide the second array;

(B) the second set of gaming elements are depicted as appearing on the display, moving on the display, and achieving a resting position on the overlay relative to the first array, in which the second set of gaming elements are situated on one or more cells, which may be disposed within cells of the first array;

(C) the position of the second set of gaming elements on the overlay is related to the position of the first set of gaming elements in the underlying cells; and (D) one or more rules are applied to determine the modifications ("modification rules"), if any, that result from the second set of gaming elements being situated in portions of the overlay that overlay with the underlying cells of the first array.

In one aspect of the invention, the overlay consists of a second array in which each cell is divided into a plurality of smaller second array portions or cells, wherein each of the second set of gaming elements is disposed in a smaller second array portion.

In another aspect of the invention, the overlay is a grid overlay. In another aspect of the invention, the interactions between the first set of gaming elements and the second set of gaming elements occur through the grid overlay only, as opposed to direct interaction in the same interface component between the first set of gaming elements and the second set of gaming elements. Therefore the interactions between the first set of gaming elements and the second set of gaming elements in one aspect may be indirect.

In a further possible implementation of the present invention, the interactions between the first set of gaming elements and the second set of gaming elements may be direct, or may include direct interactions.

In another aspect of the invention, the video gaming computer system includes a physical attribute simulator. In another aspect of the invention, the physical attribute simulator is operable to simulate:

(A) the second set of gaming elements falling on the display;

(B) the second set of gaming elements interacting physically with first set of gaming elements in way that simulates how a physical object represented by the second set of gaming elements (such as a ball or dice) would interact with a physical object represented by the first gaming elements, including based on any movements by the first set of gaming elements, as represented by the video gaming computer system in connection with movements of the first set of gaming elements associated with the first set of gaming elements achieving a resting pattern, if any.

In another aspect of the invention, the grid overlay includes a number of cells that may vary, including based on the reel configuration. The number of cells for the grid overlay may also vary for the same reel configuration.

In one aspect, any one or more of the second set of gaming elements may fall in a particular cell of the grid overlay, and this may trigger an interaction through the grid overlay of one or more of the first set of gaming elements, depending for example on the position of the second set of gaming elements. For example, where the second set of gaming elements consist of balls, a ball may fall in a cell in way that it "touches" or overlaps with one or more neighbouring gaming elements. The interactions may depend on a number of factors. For example a ball may enhance identical or associated elements of the first set of gaming elements to provide further enhancements.

The gaming outcome may be modified in a number of ways. For example, the second level winning patterns may produce a multiplier that is applied to a winning combination.

The host system (e.g., the casino's system, the gaming site, or a portal) may be implemented in a number of different ways.

In one aspect of the invention: (A) the second set of gaming elements consist of ball graphics that are dropped on a plurality of spinning reels that include symbols providing the first set of gaming elements, (B) the balls are shown to interact via the grid overlay with the spinning reels, (C) the reels come to a stop, (D) the balls settle into their final position, and (D) a +1× multiplier for example is applied for any of the first set of gaming elements that are touched by the second set of gaming elements.

Implementation

The invention may be carried out using any type of computer, including portable devices, such as smart phones, that can access a gaming site or a portal (which may access a plurality of gaming sites) via the internet or other communication path (e.g., a LAN or WAN). The invention can also be carried out using an electronic gaming machine (EGM) in a casino. One type of EGM is described with respect to FIG. 1.

The invention can also be carried out using an electronic gaming machine (EGM) in a casino. One type of EGM is described with respect to FIG. 1.

FIG. 1 is a perspective view of an EGM 10 that incorporates the present invention. EGM 10 includes a display 12 that may be a thin film transistor (TFT) display, a liquid crystal display (LCD), a cathode ray tube (CRT), and LED display, an OLED display, or any other type of display. A second display 14 provides game data or other information in addition to display 12. Display 14 may provide static information, such as an advertisement for the game, the rules of the game, pay tables, pay lines, or other information, or may even display the main game or a bonus game along with display 12. Alternatively, the area for display 14 may be a display glass for conveying information about the game.

Display 12 or 14 may have a touch screen lamination that includes a transparent grid of conductors. Touching the screen changes the capacitance between the conductors, and thereby the X-Y location of the touch may be determined. The processor associates this X-Y location with a function to be performed. Such touch screens are very well known in the field of slot machines, and a detailed description of them is not required.

A coin slot 22 may accept coins or tokens in one or more denominations to generate credits within EGM 10 for playing games. An input slot 24 for an optical reader and printer receives machine readable printed tickets and outputs printed tickets for use in cashless gaming.

A coin tray 32 may receive coins or tokens from a hopper upon a win or upon the player cashing out. However, the gaming machine 10 may be a gaming terminal that does not pay in cash but only issues a printed ticket for cashing in elsewhere. Alternatively, a stored value card may be loaded with credits based on a win, or may enable the assignment of credits to an account associated with a computer system, which may be a computer network connected computer.

A card reader slot 34 may accept any of various types of cards, such as smart cards, magnetic strip cards, or other types of cards conveying machine readable information. The card reader reads the inserted card for player and credit information for cashless gaming. The card reader may read a magnetic code on a conventional player tracking card, where the code uniquely identifies the player to the host system. The code is cross-reference by the host system to any date related to the player, and such data may affect the games offered to the player by the gaming terminal. The card reader may also include an optical reader and printer for reading and printing coded barcodes and other information on a paper ticket. A card may also include credentials that enable the host system to access one or more accounts associated with a user. The account may be debited based on wages by a user and credited based on a win.

A keypad 36 may accept player input, such as a personal identification number (PIN) or any other player information. A display 38 above keypad 36 displays a menu for instructions and other information and provides visual feedback of the keys pressed.

Player control buttons 39 may include any buttons or other controllers needed for the play of the particular game or games offered by EGM 10 including, for example, a bet button, a repeat bet button, a spin reels (or play) button, a maximum bet button, a cash-out button, a display pay lines button, a display payout tables button, select icon buttons, and any other suitable button. Buttons 39 may be replaced by a touch screen with virtual buttons.

Figure 2A:
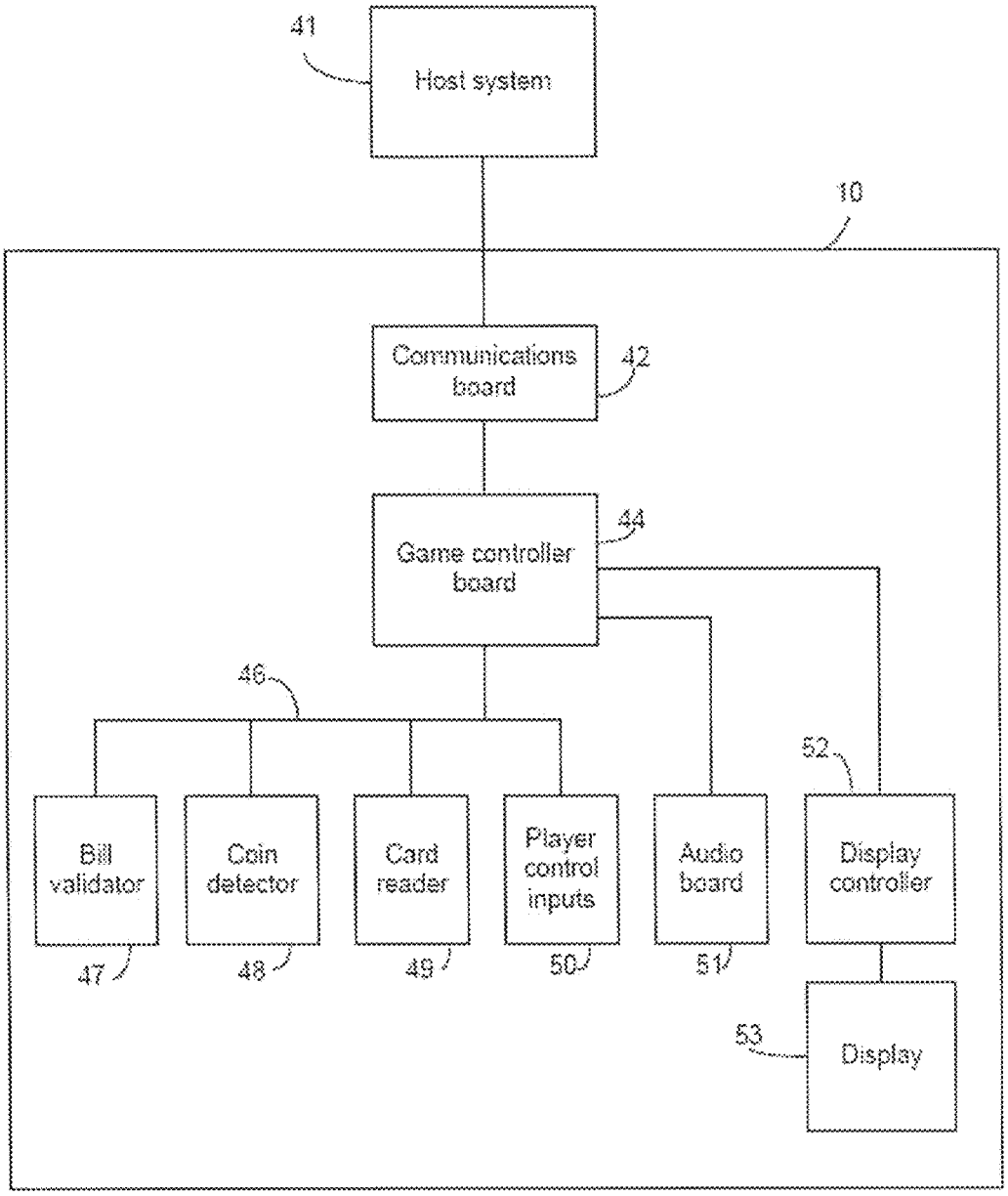
FIG. 2*a* is a block diagram showing the basic functional units in the gaming machine of FIG. 1.
Figure 2B:
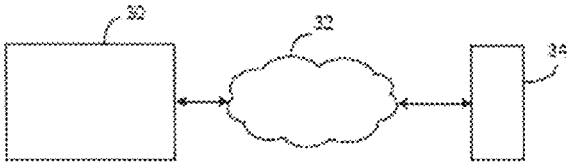
FIG. 2*b* is a block diagram illustrating an online gaming system in accordance with present invention.

FIG. 2*a* is a block diagram of EGM 10 linked to the casino's host system 41. The EGM 10 may use conventional hardware. FIG. 2*b* illustrates a possible online implementation of computer system of the present invention and online gaming in accordance with the present invention. For example, a server computer 34 may be configured to enable online gaming in accordance with the present invention. One or more users may use a computer 34 that is configured to connect to the Internet 32, and via the Internet 32 to the server computer 34 in order to access the functionality described in this disclosure.

A communications board 42 may contain conventional circuitry for coupling the EGM 10 to a local area network (LAN) or other type of network using any suitable protocol, such as the G2S protocols. Internet protocols are typically used for such communication under the G2 S standard, incorporated herein by reference. The communications board 42 transmits using a wireless transmitter, or it may be directly connected to a network running throughout the casino floor. The communications board 42 basically sets up a communication link with a master controller and buffers data between the network and the game controller board 44. The communications board 42 may also communicate with a network server, such as in accordance with the G2S standard, for exchanging information to carry out the present invention.

The game controller board 44 contains memory and a processor for carrying out programs stored in the memory and for providing the information requested by the network. The game controller board 44 primarily carries out the game routines.

Peripheral devices/boards communicate with the game controller board 44 via a bus 46 using, for example, an RS-232 interface. Such peripherals may include a bill validator 47, a coin detector 48, a smart card reader or other type of credit card reader 49, and player control inputs 50 (such as buttons or a touch screen).

The game controller board 44 also controls one or more devices that produce the game output including audio and video output associated with a particular game that is presented to the user. For example auto board 51 converts coded signals into analog signals for driving speakers. A display controller 52, which typically requires a high data transfer rate, converts coded signals to pixel signals for the display 53. Display controller 52 and audio board 51 may be directly connected to parallel ports on the game controller board 44.

The electronics on the various boards may be combined onto a single board.

Figure 3:
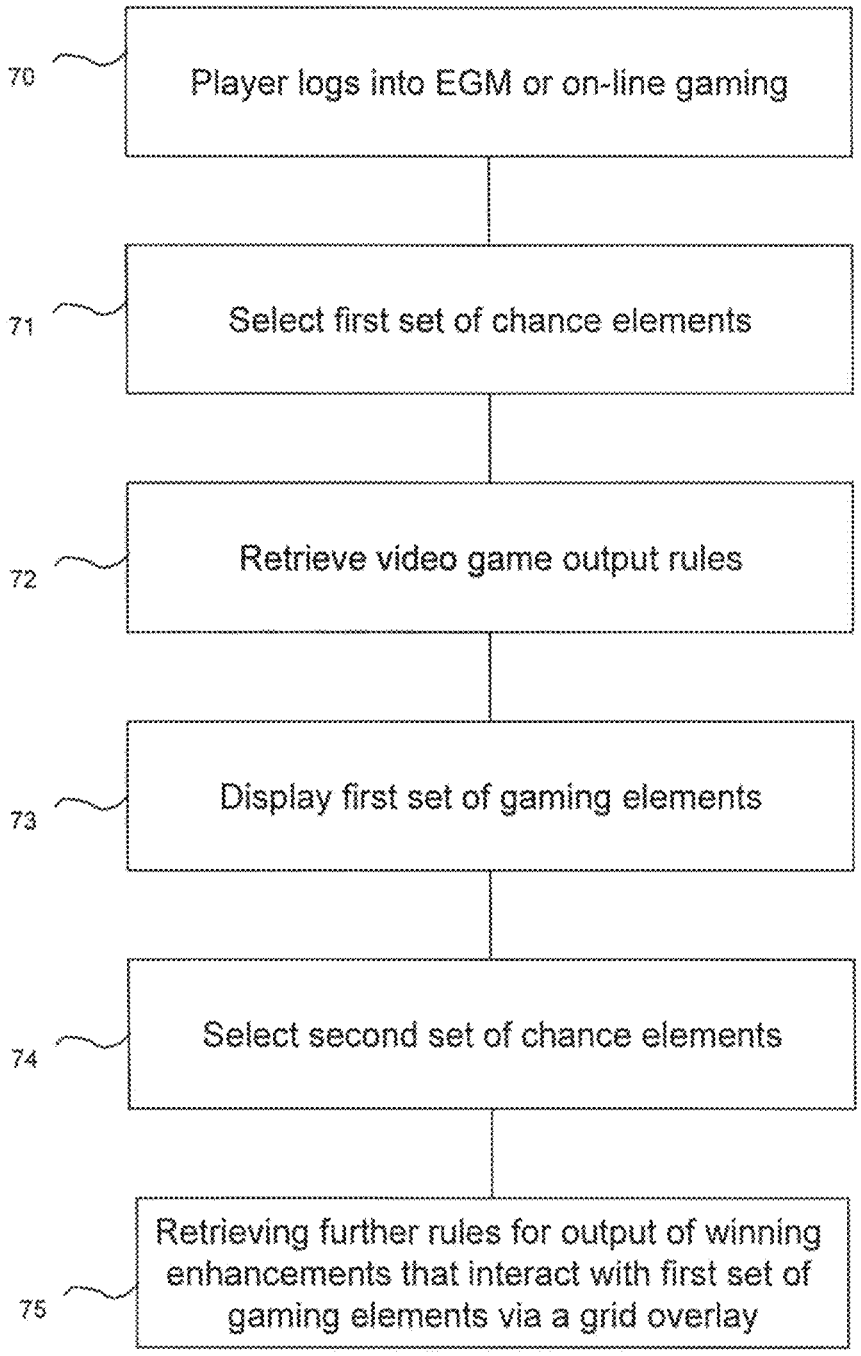
FIG. 3 is a flowchart showing steps performed by a gaming system implementing one embodiment of the invention.

FIG. 3 is a flowchart showing steps performed by a gaming system implementing one embodiment of the invention. The gaming system may be a casino system communicating with an EGM or an on-line gaming system where the player accesses a gaming site via the internet using a generic computer. As shown in FIG. 3, in one implementation of the present invention: the player logs into the EGM or on-line gaming portal 70; the system selects a first set of chance elements 71; the system retrieves applicable video game output rules 72; the associated gaming elements are retrieved and displayed 73; the system selects a second set of chance elements 74; and the system retrieves applicable winning enhancement rules, and displays the second set of chance elements as interacting with the first set of chance elements via the grid overlay.

Incorporation of Winning Enhancements in Games

In one aspect of the invention, a video gaming computer system of gaming system is provided that incorporates the winning enhancements described in this disclosure. The gaming system may include a computer program, configured to implement the winning enhancements of the present invention.

Figure 4:
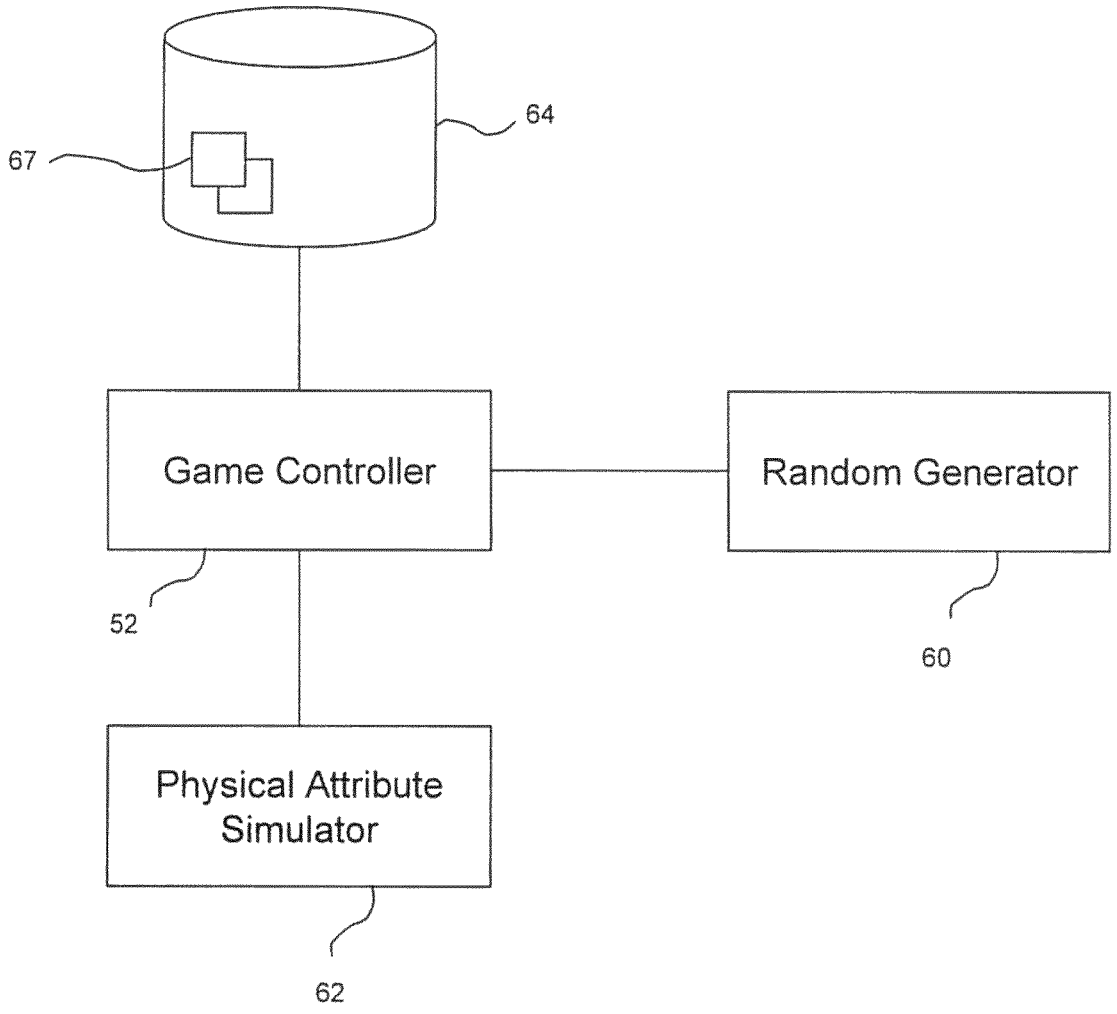
FIG. 4 is a system and program architecture diagram.

A representative video gaming computer system and video gaming computer program architecture in accordance with the present invention is shown in FIG. 4*a*, and may include: (A) a game controller 52, and (B) a random generator module 60. The game controller 52 may embody the various gaming rules 61 associated with pattern games including rules of play (including pay-out rules) and game display rules (including the winning enhancements) based on present invention. Alternatively, the game controller 52 may be connected to a gaming rule repository 64.

As previously described, a random selector may be implemented by the random generator module 60. The random generator module 60 generates random selections, as part of the gaming rules, thereby producing gaming outcomes. The video gaming computer system, using the gaming controller 52, generates gaming output the winning enhancements described in the present disclosure, which provides a more engaging and stimulating game. The gaming output may include audio, video, and possible smell as well.

The gaming controller 52 generates and displays a first level winning pattern (corresponding to a first random selection of the random generator module 60) and a second level winning pattern (corresponding to the first random selection), in a way that the second level winning pattern is presented to the user as impacting on the outcome(s) associated with the first level winning pattern.

In one implementation the gaming controller 52 is operable to generate and to present on a display (such as a screen) the first array, and the second array as an overlay on the first array.

The gaming controller 52 may embody one or more rules that are applied to determine the gaming output modifications ("modification rules"), if any, that result from the second set of gaming elements being situated in portions of the overlay that overlap with the underlying cells. The gaming controller 52 may include a physical attribute simulator 62. In another aspect of the invention, the physical attribute simulator 62 is operable to simulate: (A) the second set of gaming elements falling on the display; and (B) the second set of gaming elements interacting physically with first set of gaming elements in way that simulates how the physical object(s) represented or simulated by the second set of gaming elements would interact with the physical object (s) represented or simulated by the first gaming elements, including based on any movements by the first set of gaming elements, as represented by the video gaming computer system in connection with movements of the first set of gaming elements associated with the first set of gaming elements achieving the resting pattern, if any.

Gaming Displays with Winning Enhancements

A skilled reader will appreciate that many possible gaming output presentations are possible. Gaming output of the present invention, incorporating winning enhancements may include a first set of gaming elements and an overlay of a second set of gaming elements, where the first set of gaming elements are at least visible in part despite the display of the second set of gaming elements. The second set of gaming elements therefore do not generally replace the first set of gaming elements, but rather the second set of gaming elements enhance the first set of gaming elements, thereby providing a more engaging and simulating game. Also, the gaming controller may generate the gaming output in a way that simulates physical interactions between the first set of gaming elements and the second set of gaming elements.

For example the first set of gaming elements may include spinning reels, and the second set of gaming elements may include balls that interact physically with the spinning reels in that the gaming controller simulates that (A) the balls are dropped over the spinning reels, (B) this results in the display of the balls bouncing in a manner that is similar to the motions that would be produced if rubber balls were dropped over mechanical spinning reels. The simulation may include the reels and the balls eventually achieving a stationary state and depending on the locations of the balls in their stationary state relative to patterns on the wheels, a wining pattern based on both the spinning reels and the balls may be simulated.

Various examples are provided below.

In one possible implementation of the present invention, a new and innovative spinning reel type game is provided with new functions and gaming output.

Figure 5A:
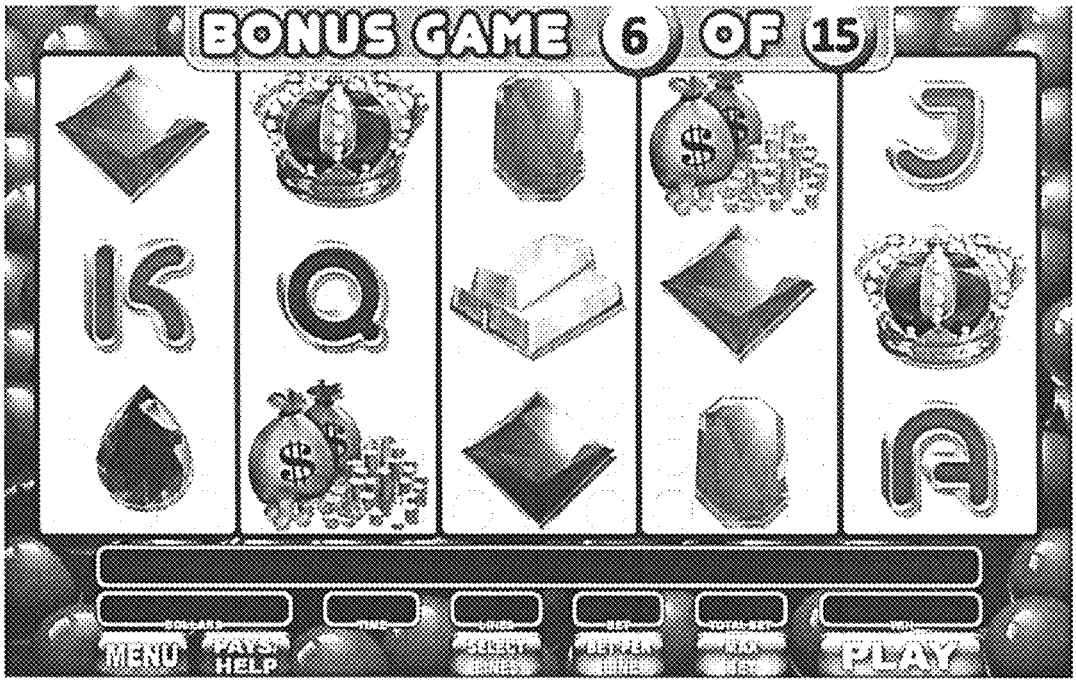
FIG. 5*a* illustrates a representative gaming output in accordance with one aspect of the invention.

In one implementation, in addition to a plurality of reels including gaming elements spinning to match the gaming elements, a random number of representations of physical objects (such as balls, dice or other such objects) may be "dropped" every spin of the reels. These representations of physical objects interact physically with the reels, for example they may tumble around the settle into place over top of a gaming element array of matrix such as a 3×5 symbol array as shown in FIG. 5*a*.

The rules associated with the game may define one or more outcomes based on associations between the gaming elements and the representations of physical objects. A skilled reader will understand that the random generator determines whether there is a winning outcome or not, and then based on the rules the video gaming computer system controls the display to lead to the winning outcome or not, based on the display of a set of stimulating and engaging interactions. The contribution of the invention is the winning enhancements and a series of possible graphical user interfaces for their display, as described herein, in order to provide more engaging and stimulating games. More specifically, a skilled reader will understand that visually the games described herein are more stimulating than prior art games.

In one aspect of the invention, the wining enhancements of the present invention do not replace the gaming elements, but rather they are displayed in a way that still enables the user to see the gaming elements (at least in part) with which the representations of physical objects interact, thereby providing the winning enhancements.

Figure 5B:
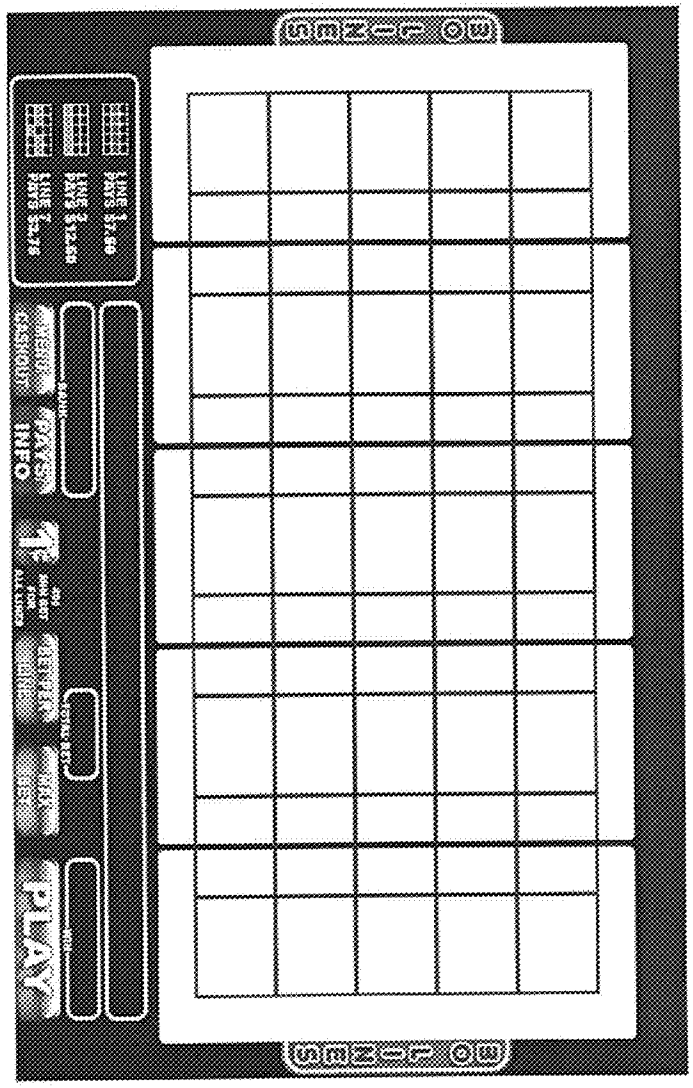
FIGS. 5*b* and 5*c* illustrate representative embodiments of the first/second arrays in accordance with the present invention.
Figure 5C:
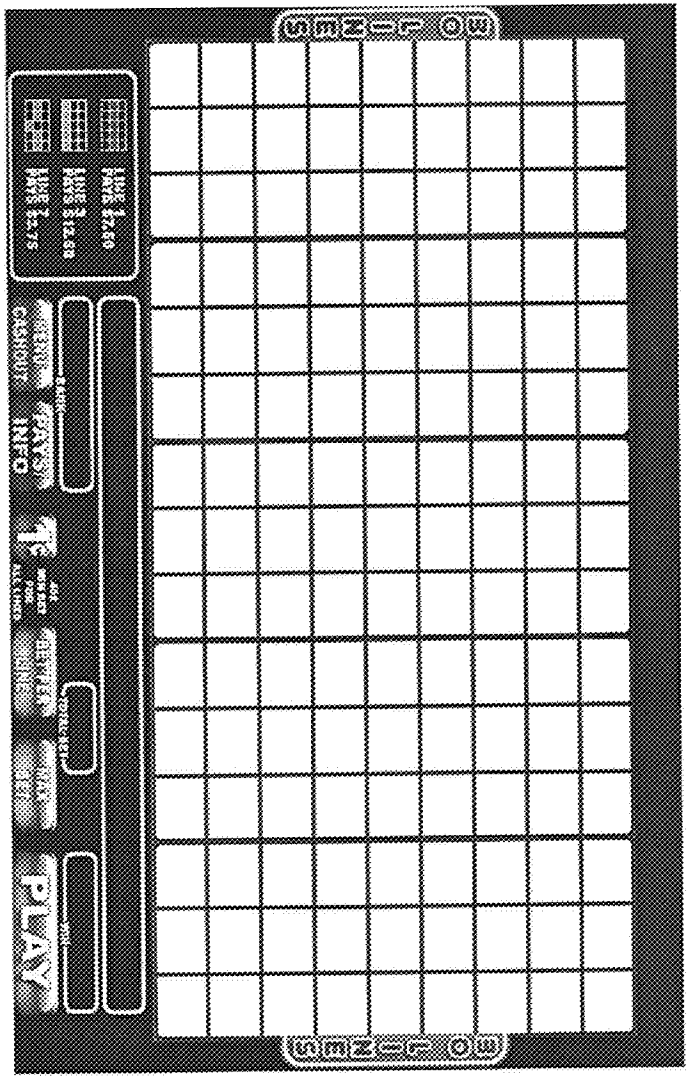
Figure 5D:
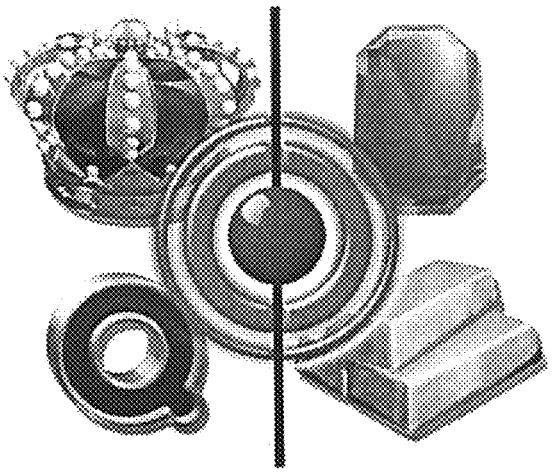
FIGS. 5*d* to 5*g* illustrate representative embodiments of the winning enhancements aspects of gaming output in accordance with the present invention.

In one implementation, the representations of the physical objects are displayed using an overlay, the physical arrangements being arranged by the video gaming computer system on the overlay in a manner that allows a user to see the underlying gaming elements in whole or in part. FIG. 5*b* illustrates a possible overlay for receiving representations of the physical objects, namely a landing position grid for balls on top of the matrix shown for example in FIG. 5*a*.

A skilled reader will also understand that multiple overlays may be used, and used by the video gaming computer system to manage various arrangements of winning enhancements. One possible implementation of the present invention with at least a first and second overlay for providing winning enhancements in accordance with the present invention is provided.

Generally speaking the physical object representations move independently of the reels, and tumble while the reels spin, and then settle on the underlying gaming elements shown on the reels. Various play rules may be defined displaying a series of events that will result in a display associated with a winning combination. Also various physical interaction rules may determine the manner in which the physical object representations are shown to move, and the manner in which they interact physically with the underlying gaming elements.

For example the physical object representations may take the form of balls of different colours, each colour having different physical interaction rules and play attributes.

In one representative implementation of the invention, and a possible gaming output, representations of balls may be used, and these may be of different colours such as PURPLE or BLUE balls, and these may have for example a multiplier effect depending on the gaming element on which they land (based on the cell in the applicable array on which they land). If these balls are involved in a winning combination for example, the video gaming computer system may tally the results, including any first array wining combinations and any multiplier effects of the PURPLE or BLUE balls depending on the gaming element on which they may have landed.

In one representative implementation, PURPLE balls may add a +1 multiplier to the corresponding win and the BLUE balls may add a +5 multiplier.

There may also be GREEN balls which may for example be slightly larger than PURPLE or BLUE balls, and may be placed in a different overlay or invisible grid, for example as shown in FIGS. 5*d* to 5*g*.

In one implementation, once the balls stop moving and are shown to have reached a resting position, the gaming computer system presents the outcomes associated with application of the play rules. For example, the display presents messaging indicating that a multiplier ball adds a particular multiplier to a win, and this may trigger one or more animated sequence to indicate its multiplication value. For example, the animation may make the ball look like its turning to show text on the ball. The text may for example show the text "+5×".

In one possible implementation, the GREEN ball may animate to cover any overlapping symbols and turn them into wild symbols, for example as shown in FIGS. 5*d* to 5*g*.

In one aspect, the winning enhancements may provide bonus trigger gaming elements such that when the reels begin spinning, the bonus trigger gaming elements animate to create an illusion of a pile of balls beginning to fall downward. The pile may appear to stretch out and separate to take up more vertical space, possible to around double the original size of the height of the original graphic. The animated frame showing the balls at their most separated/expanded may remain visible throughout the entire time the reels are spinning. The animation may continue when the reels come to a stop and the balls will appear to collapse back into place as they were before the animation began. In one implementation, the animation is programmed to create a fluid effect.

In one implementation, when the reels stop, if three or more bonus trigger gaming elements are visible, this is a trigger for each of the bonus trigger gaming elements to appear as if a pile of balls explodes into the air toward the player's vantage point, then disappears off screen.

A skilled reader will appreciated that different play rules may apply to different winning enhancements. Various other play rules are possible.

For example a +5× multiplier ball may only drop during particular game spins for example during certain game spins. Various additional gaming features are possible such as different types of matrices, different line counts, different directional pays, different denominations, different volatility values, different hit/win frequencies, double-up or extended play features.

The game may incorporate localization features that permit the localization of a video gaming computer system for local requirements such as language (audio and video), currency, time display, and possibly other cultural requirements.

Different types of players, including for example players from different countries or regions may have different expectations of games of this nature. A skilled reader will also appreciate that the video gaming computer system may incorporate features that enable an administrative user, for example using an administration utility, to determine one or more settings, for example relating to localization. These settings may also enable the administrative user to tune operation of the games in accordance with the present invention with expectations of local users.

A skilled reader will also understand that the various betting strategies may be applied to the present invention.

In one implementation of the present invention, a plurality of gaming elements is provided. For example there may be 10 different types of gaming elements, and one or more additional gaming elements trigger the winning enhancements. The additional gaming elements may be shown as special animated objects, for example, a bonus trigger gaming element, and also three different types of balls that land on gaming elements to enhance wins.

In one implementation, gaming elements (excluding winning enhancements) ma be associated with one or more animated effects such as a panning highlight or shine, and thus may be modeled in 3D. This may be used such that when the reels are spinning and the gaming elements pass through one or more designated areas, they may appear to shine. This aspect may be used for example to initiate celebration animations if the winning enhancements result in a winning combination for example.

In one particular implementation of the invention, the gaming elements may be associated with attributes, and these may be hierarchical.

In one aspect, the impact of bonus trigger gaming elements may depend on where these gaming elements "land" and settle on a cell of the first array. In one particular implementation of the present invention; a GREEN ball may (A) land on a single gaming element, (B) land between two vertical gaming elements, (C) land between two horizontal gaming elements, or (D) land between four gaming elements. If a GREEN ball contributes to a win, the GREEN ball may contribute to the win and initiate on of four possible animations, depending on the position of the ball.

Figure 5E:
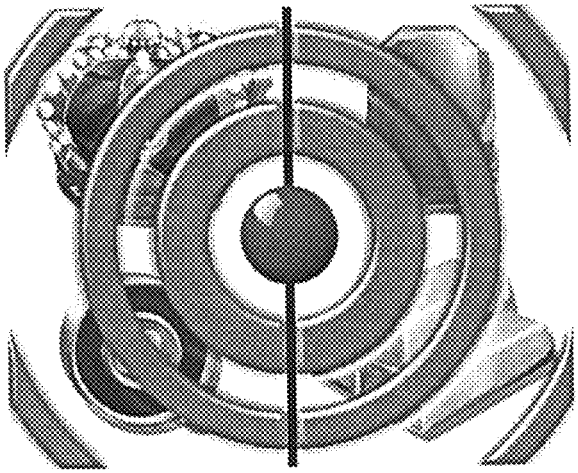
Figure 5F:
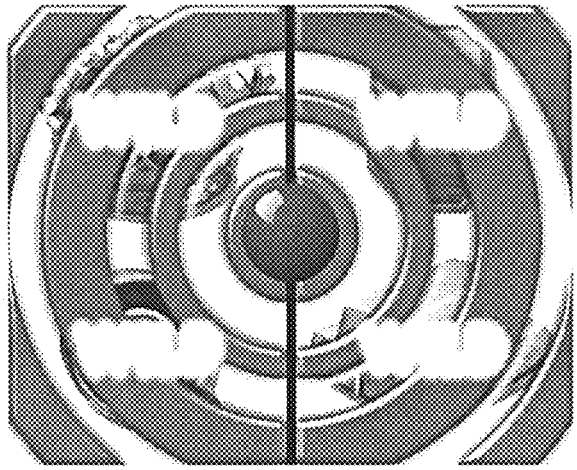
Figure 5G:
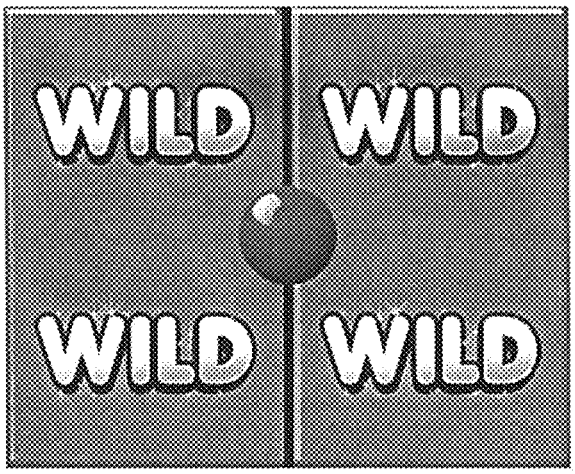

Once all reels have stopped and all balls have landed, any wild balls may begin to animate to display a rippling ring effect radiating outwards from the ball, to cover all overlapping symbols, as shown in FIG. 5*e*. This animation may be displayed regardless of whether the wild balls contribute to a win or not. As shown in FIG. 5*e*, because the GREEN ball landed in between four gaming elements, the rings radiate toward all four gaming elements, and turn each of these to four symbols and turn each overlapping symbol green. Optionally, if there is a winning combination overlapping gaming elements may be turned green.

Various marketing messages may be displayed in conjunction with the gaming output. Some of the marketing messages will not always be visible. When a marketing message is displayed, a message window for displaying animated marketing messages may animate one or more marketing message. Various arrangements are possible.

In another possible implementation, the gaming output may include bonus trigger anticipation features that may involve slowing down of any spinning reels which could potentially deliver a third, fourth or fifth bonus trigger symbol. In addition to this effect, trigger symbols will also involve an animated effect to heighten anticipation.

In one implementation, when the reels begin spinning, any bonus trigger gaming elements on screen animate to appear as if the pile of balls in the element graphic begin to drop. This creates the appearance that all balls gradually start to fall and separate, causing the trigger symbol graphic to increase to the size of 2 vertical symbols. The increased size will cause the symbol to be more visible while the reels are spinning.

In one implementation, a "Greenball Bonus" may be triggered by 3, 4, or 5 scattered bonus trigger gaming elements anywhere on reels 1 to 5. For example, 10, 15, and 20 Free Games may be awarded for 3, 4, or 5 scattered bonus trigger gaming elements respectively. Multiplier balls and Wild balls will still drop during the Bonus game. At least one Greenball (Wild Ball) may be guaranteed to drop every spin during the Bonus. The player can also retrigger the Bonus to a maximum of 150 games, in one example implementation.

In one implementation, the game includes an exit strategy that includes a Free Spin, after which the Bonus game transitions back to the main game by displaying a popup window over top of the reels to tally the player's entire bonus wirings. Then the entire screen (including the popup) fades out to reveal the main game screen as it was when the bonus was triggered.

The video gaming computer system may include a dashboard to enable users to access different features of the present invention, such as selection between different collections of gaming elements.

Various other animated features are possible. In addition various accompanying sound features may also be implemented by the invention. These features may depend on gaming outcomes.

Further Details of Implementation

The user interfaces, computer implemented methods, and computer system components described may be use in connection with a variety of different games that are pattern games or that include pattern game components. A skilled reader will understand that the present invention may be used not only for reel-type games but also for a wide variety of other types of games such as poker games, keno games, lottery games or any other type of games.

A skilled reader will understand that various functions or features described in this disclosure may be implemented as part of different gaming systems. For example:

(A) The winning enhancements may be implemented as part of a game to system (G2S) system.

(B) As previously stated, the user interfaces, computer implemented methods, and computer system components described herein may be used by an EGM.

(C) In the event the game is a lottery game, the game computer may be an in store gaming system or a gaming kiosk. For lottery games including the winning enhancements of the present invention, the host system may be controlled by a government agency.

The game may be played on a standalone video gaming machine, a gaming console, on a general purpose computer connected to the Internet, on a smart phone, or using any other type of gaming device. The video gaming system may include multiplayer gaming features.

The game may even be played on a social media platform, such as Facebook™. The video gaming computer system may also connect to a one or more social media platforms, for example to include social features. For example the video gaming computer system may enable the posting of results as part of social feeds. In some applications, no monetary award is granted for wins, such as in some on-line games. For playing on social media platforms, non-monetary credits may be used for bets and an award may comprise similar non-monetary credits that can be used for further play or to have access to bonus features of a game. All processing may be performed remotely, such as by a server, while a player interface (computer, smart phone, etc.) displays the game to the player.

Those skilled in the art may write the appropriate software to carry out the invention without undue experimentation. The functionality described herein may also be accessed as an Internet service, for example by accessing the functions or features described from any manner of computer device, by the computer device accessing a server computer, a server farm or cloud service configured to implement said functions or features. The functionality described may be implemented as a mobile application or tablet computer program or a web application configured for use using for example a smart phone or a tablet computer.

While particular embodiments of the present invention have been shown and described, it will be obvious to those skilled in the art that changes and modifications may be made without departing from this invention in its broader aspects. The appended claims are to encompass within their scope all such changes and modifications as fall within the true spirit and scope of this invention.

What is claimed is:

1. A computer implemented method for integrating winning enhancements with a video game performed by a video gaming computer device comprising at least one gaming device processor, at least one gaming device memory device storing a plurality of gaming device instructions, a display device connected to the at least one gaming device processor, a plurality of input devices including an acceptor of a first physical item associated with a first monetary value and a cash-out button actuatable to cause an initiation of a payout associated with credits, the computer implemented method comprising:

selecting on a random or pseudorandom basis a first set of chance elements, that determine a first gaming outcome;

retrieving, from a persistent store, one or more rules adapted for generating and displaying video gaming output based on the first set of chance elements, the video gaming output including a first set of gaming elements organized in a first array;

displaying, using a display device of the video gaming computer device, the first set of gaming elements;

selecting on a random or pseudorandom basis a second set of chance elements that determine a second gaming outcome;

retrieving, from the persistent store, one or more rules adapted for generating and displaying video gaming output based on the second set of chance elements as a second set of gaming elements that produce winning enhancements, the second set of gaming elements being organized in a second array;

generating, using a processor, a grid overlay relative to the first array, the grid overlay comprising a plurality of cells, wherein at least one cell of the plurality of cells overlaps with a plurality of neighboring gaming elements of the first set of gaming elements, wherein the second array is the grid overlay to the first array;

displaying the winning enhancements in way that simulates, by a display controller on the display device linked to a physical attribute simulator, a plurality of physical objects, each representative of one of the first or the second set of gaming elements, and simulates a plurality of physical interactions amongst the physical objects, the physical interactions including collisions and movements of the physical objects;

simulating, by the display controller on the display device linked to the physical attribute simulator, at least one gaming element of the second set of gaming elements coming to a resting position in the at least one cell of the grid overlay that overlaps with the plurality of neighboring gaming elements of the first set of gaming elements; and providing, by the processor, data signals defining the winning enhancements impacting the first gaming outcome associated with any winning combination involving the plurality of neighboring gaming elements of the first set of gaming elements;

wherein the first set of gaming elements are represented by symbols displayed on moving reels, and the display controller board simulates additional symbols being dropped over the moving reels, and the additional symbols colliding with the surface of the moving reels, and with one another, until the additional symbols achieve a resting position; and wherein in the resting position at least one additional symbol achieves a position in the at least one cell that overlaps with the plurality of neighboring game elements, and based on this position or collective position, a gaming outcome is displayed.

2. The method of claim 1, comprising simulating, by the processor on the display device, that the second set of gaming elements modifies the first gaming outcomes depending on the simulated physical interactions between the physical objects representative of the first set of gaming elements and the second set of gaming elements so as to produce a second gaming outcome based on the winning enhancements.

3. The method of claim 1, wherein the first array includes a plurality of cells for receiving the gaming elements, and the second array includes a plurality of cells that fit within at least one cell of the first array.

4. The method of claim 1, wherein the first set of gaming elements are represented by reels, and the second set of gaming elements are represented by balls capable of interacting physically with the reels, wherein the physical interaction comprises dropping the balls onto the spinning reels, wherein the physical interaction continues after the balls come to the resting position via the grid overlay, wherein movement of the balls correlates to the overlay grid and not the first array of the first set of gaming elements.

5. The method of claim 1, wherein using a display controller:

the second set of gaming elements are depicted as appearing on the display, and moving on the display in a way that interacts with the first set of gaming elements; and at least one second set of gaming element in the resting position overlaps a plurality of gaming elements of the first set of gaming elements.

6. The method of claim 5, comprising:

accessing one or more gaming rules that determine the gaming outcomes, if any, associated with the placement of second set of gaming elements relative to the first set of gaming elements in the resting position; and applying the gaming rules to calculate winnings if any, and displaying messaging based on application of the gaming rules.

7. The method of claim 1, comprising:

using the second set of gaming elements to produce, using the display controller, a simulation of one or more of the physical objects represented by the second set of gaming elements falling on one or more of the physical objects representing the first set of gaming elements;

wherein the simulation is based on how the physical objects representing the second set of gaming elements would interact physically with the physical objects representing the first set of gaming elements.

8. The method of claim 1, wherein the number of cells for the grid overlay may vary for the same reel.

9. The method of claim 1, wherein the first set of gaming elements comprises symbols displayed on reels, wherein the second set of gaming elements comprises ball graphics, wherein the method further comprises:

simulating spinning of the plurality of reels that comprise symbols providing the first set of gaming elements;

simulating dropping of the ball graphics onto the plurality of spinning reels;

simulating the ball graphics of the second set of gaming elements interacting physically with the plurality of spinning reels; and simulating a ball graphic come to the resting position so as to overlap a plurality of symbols displayed on the reels.

10. The method of claim 1, wherein the physical interactions comprise movement of the second set of gaming elements, wherein the movement of the second set of gaming elements correlates to the grid overlay and not the first array of the first set of gaming elements.

11. A gaming device comprising:

a display screen;

a display controller coupled to the display screen to control display output;

a plurality of input devices, including an acceptor of a first physical item associated with a first monetary value;

a cash-out button actuatable to cause an initiation of a payout associated with credits; and a processing system running a game computer program to configure the processing system to perform operations of:

selecting on a random or pseudorandom basis a first set of chance elements, that determine a first gaming outcome;

retrieving one or more rules adapted for generating and displaying video gaming output based on the first set of chance elements, the video gaming output including a first set of gaming elements organized in a first array;

displaying, using the display controller, the first set of gaming elements on the display screen;

selecting on a random or pseudorandom basis a second set of chance elements that determine a second gaming outcome;

retrieving one or more rules adapted for generating and displaying video gaming output based on the second set of chance elements as a second set of gaming elements that produce winning enhancements, the second set of gaming elements being organized in a second array;

generating, using a processor, a grid overlay relative to the first array, the grid overlay comprising a plurality of cells, wherein at least one cell of the plurality of cells overlaps with a plurality of neighboring gaming elements of the first set of gaming elements, wherein the second array is the grid overlay to the first array; and displaying, by the display controller on the display device linked to a physical attribute simulator, the displaying including simulation of a plurality of physical objects, each representative of one of the first or second set of gaming elements, and simulation of the physical objects representing the second set of gaming elements engaging in physical interactions with the physical objects representing the first set of gaming elements via the grid overlay, the physical interactions including collisions and movements of the physical objects;

displaying, by the display controller on the display device linked to a physical attribute simulator, simulation of at least one gaming element of the second set of gaming elements coming to a resting position in the at least one cell that overlaps with the plurality of neighboring gaming elements of the first set of gaming elements; and providing, by the processor, data signals defining the winning enhancements impacting the first gaming outcome associated with any winning combination involving the plurality of neighboring gaming elements of the first set of gaming elements;

wherein the first set of gaming elements are represented by symbols displayed on moving reels, and the display controller board simulates additional symbols being dropped over the moving reels, and the additional symbols colliding with the surface of the moving reels, and with one another, until the additional symbols achieve a resting position; and wherein in the resting position at least one additional symbol achieves a position in the at least one cell that overlaps with the plurality of neighboring game elements, and based on this position or collective position, a gaming outcome is displayed.

12. The gaming device of claim 11, wherein the first set of gaming elements comprises symbols displayed on reels, wherein the second set of gaming elements comprises ball graphics, wherein the processing system is further configured for:

simulating spinning of the plurality of reels that comprise symbols providing the first set of gaming elements;

simulating dropping of the ball graphics onto the plurality of spinning reels;

simulating the ball graphics of the second set of gaming elements interacting physically with the plurality of spinning reels; and simulating a ball graphic come to a resting position so as to overlap a plurality of symbols displayed on the reels.

13. A gaming computer system for incorporating winning enhancements into a video game comprising:

at least one gaming device processor;

at least one gaming device memory device storing a plurality of gaming device instructions;

a display device connected to the at least one gaming device processor;

a plurality of input devices, including an acceptor of a first physical item associated with a first monetary value;

a cash-out button actuatable to cause an initiation of a payout associated with credits;

a display controller board configured that is operable to access a plurality of gaming rules, including (i) rules of play (including pay-out rules) and game display rules, and, based on the gaming rules, to generate gaming output for display to the users;

a random or pseudorandom generator linked to the display controller and operable to generate random or pseudorandom selections, as part of the gaming rules, thereby producing gaming outcomes;

a gaming controller board, based on random or pseudorandom selection(s) of the random or pseudorandom generator, configured to generate a first level winning pattern consisting of a first set of gaming elements, and a second level winning pattern consisting of a second set of gaming elements, wherein the second level winning pattern is rendered as a visual overlay to the first level winning pattern, wherein the second level winning pattern comprises at least one gaming element of a second set of gaming elements overlapping a plurality of neighboring gaming elements of the first set of gaming elements in the first winning pattern; and a physical attribute simulator unit coupled to the display controller board and the gaming controller board, the physical attribute simulator configured to control the display controller board to represent or simulate a plurality of physical objects, each representative of one of the first or second set of gaming elements, and to represent or simulate the physical objects representative of the second set of gaming elements engaging in physical interactions with the physical objects representative of the first set of gaming elements through the overlay, the physical interactions including collisions and movements of the physical objects, wherein the first set of gaming elements are represented by symbols displayed on moving reels, and the display controller board simulates additional symbols being dropped over the moving reels, and the additional symbols colliding with the surface of the moving reels, and with one another, until the additional symbols achieve a resting position; and wherein in the resting position, at least one of the additional symbols provides the at least one gaming element of the second set of gaming elements that overlaps the plurality of neighboring gaming elements, and based on the resting position a gaming outcome is displayed.

14. The gaming computer system of claim 13, wherein the physical interactions simulate the way the moving physical objects would interact in the physical world.

15. The gaming computer system of claim 13, wherein the gaming rules include one or more rules that are applied to determine the modification of the gaming output based on the winning enhancements.

16. The gaming computer system of claim 13, wherein the additional symbols are virtual balls or virtual dice, the resting position of the virtual balls or virtual dice relative to the plurality of underlying symbols being determined through the use of a grid matrix associated with the plurality of underlying symbols and the cells of the grid matrix upon which the virtual balls or virtual dice are determined to be resting upon are indicative of which of the plurality of underlying symbols are selected for rendering and provisioning of a gaming enhancement.

17. The gaming computer system of claim 13, wherein the additional symbols are virtual balls or virtual dice, wherein the resting position of the virtual balls or virtual dice relative to the plurality of underlying symbols causes the gaming outcome of turning the underlying symbols into wild symbols.

18. A non-transitory computer-readable medium having computer-executable instructions stored thereon for operation on an electronic gaming system having at least at least one gaming device processor; at least one gaming device memory device storing a plurality of gaming device instructions, a display device connected to the at least one gaming device processor, a plurality of input devices, including an acceptor of a first physical item associated with a first monetary value, and a cash-out button actuatable to cause an initiation of a payout associated with credits, the non-transitory computer-readable medium comprising:

a display control module that is operable to access a plurality of gaming rules, including (i) rules of play (including pay-out rules) and game display rules, and based on the gaming rules generate gaming output for display to the users using the display device; the display controller including or being linked to a physical attribute simulator; and a random or pseudorandom generator module linked to the display controller and operable to generate random or pseudorandom selections, as part of the gaming rules, thereby producing gaming outcomes;

wherein based on random or pseudorandom selection(s) of the random or pseudorandom generator module, the gaming control module generates a first level winning pattern consisting of a first set of gaming elements, and a second level winning pattern consisting of a second set of gaming elements, wherein the second level winning pattern is an overlay to the first level winning pattern, wherein the second level winning pattern comprises at least one gaming element of a second set of gaming elements overlapping a plurality of neighboring gaming elements of the first set of gaming elements in the first winning pattern; and wherein the physical attribute simulator enables the display control module to represent or simulate a plurality of physical objects, each representative of one of the first or second set of gaming elements, and to represent or simulate the physical objects representative of the second set of gaming elements engaging in physical interactions with the physical objects representative of the first set of gaming elements through the overlay, the physical interactions including collisions and movements of the physical objects, so as to produce one or more gaming outcomes comprising winning enhancements impacting any winning combination involving the plurality of neighboring gaming elements;

wherein the first set of gaming elements are represented by symbols displayed on moving reels, and the display controller board simulates additional symbols being dropped over the moving reels, and the additional symbols colliding with the surface of the moving reels, and with one another until the additional symbols achieve a resting position; and wherein in the resting position at least one of the additional symbols provides the at least one gaming element of the second set of gaming elements that overlaps the plurality of neighboring gaming elements, and based on the resting position a gaming outcome is displayed.

19. A computer program for instructing one or more computers to perform a method for integrating winning enhancements with a video game performed by a video gaming computer device having at least at least one gaming device processor; at least one gaming device memory device storing a plurality of gaming device instructions, a display device connected to the at least one gaming device processor, a plurality of input devices, including an acceptor of a first physical item associated with a first monetary value, and a cash-out button actuatable to cause an initiation of a payout associated with credits, the method comprising:

selecting on a random or pseudorandom basis a first set of chance elements, that determine a first gaming outcome;

retrieving one or more rules adapted for generating and displaying video gaming output based on the first set of chance elements, the video gaming output including a first set of gaming elements organized in a first array;

displaying the first set of gaming elements;

selecting on a random or pseudorandom basis a second set of chance elements, that determine a second gaming outcome;

retrieving one or more rules adapted for generating and displaying video gaming output based on the second set of chance elements as a second set of gaming elements that produce winning enhancements, the second set of gaming elements being organized in a second array;

generating, using a processor, a grid overlay relative to the first array, the grid overlay comprising a plurality of cells, wherein at least one cell of the plurality of cells overlaps with a plurality of neighboring gaming elements of the first set of gaming elements, wherein the second array is the grid overlay to the first array;

simulating, by a display controller on the display device linked to a physical attribute simulator, a plurality of physical objects, each representative of one of the first or the second set of gaming elements, and a plurality of physical interactions amongst the physical objects, the physical interactions including collisions and movements of the physical objects;

simulating, by the display controller on the display device linked to the physical attribute simulator, at least one gaming element of the second set of gaming elements coming to a resting position in the at least one cell of the grid overlay that overlaps with the plurality of neighboring gaming elements of the first set of gaming elements; and providing, by the processor, data signals defining the winning enhancements impacting the first gaming outcome associated with any winning combination involving the plurality of neighboring gaming elements of the first set of gaming elements;

wherein the first set of gaming elements are represented by symbols displayed on moving reels, and the display controller board simulates additional symbols being dropped over the moving reels, and the additional symbols colliding with the surface of the moving reels, and with one another, until the additional symbols achieve a resting position; and wherein in the resting position at least one additional symbol achieves a position in the at least one cell that overlaps with the plurality of neighboring game elements, and based on this position or collective position, a gaming outcome is displayed.

* * * * *